United States Patent [19]

Groner

[11] Patent Number: 4,616,832

[45] Date of Patent: Oct. 14, 1986

[54] ELECTRICAL HIDDEN MOVEMENT GAME

[76] Inventor: Guy H. Groner, 32 Glen Aire Dr., Springfield, Ill. 62703

[21] Appl. No.: 707,238

[22] Filed: Mar. 1, 1985

[51] Int. Cl.[4] ..... A63F 3/00

[52] U.S. Cl. ..... 273/238; 273/265; 273/285; 273/287; 273/288

[58] Field of Search ..... 273/265, 237, 238, 1 E; 434/341

[56] References Cited

U.S. PATENT DOCUMENTS

| | | | |
|---|---|---|---|
| 2,799,505 | 7/1957 | Lyons | 273/238 |
| 3,376,041 | 4/1968 | Anderson | 273/238 |
| 3,473,808 | 10/1969 | Parker | 260/465.4 |
| 3,537,708 | 11/1970 | Carr | 273/238 |
| 3,640,536 | 2/1972 | Godmer | 273/238 |
| 3,887,189 | 6/1975 | Dawes | 273/238 |

*Primary Examiner*—Richard C. Pinkham
*Assistant Examiner*—Matthew L. Schneider
*Attorney, Agent, or Firm*—Senniger, Powers, Leavitt and Roedel

[57] ABSTRACT

A game comprising a game board having at least a pair of substantially identical playing surfaces, one for each game player, with each playing surface positioned so that the playing surface for any one game player is obscured from the view of all other game players, and a plurality of playing pieces. Each playing surface has a plurality of receptacles arranged in substantially identical patterns for positioning playing pieces. Receptacles on one playing surface have respective electrical terminals for common connection to one terminal of an A.C. power source while the receptacles on a second playing surface have respective electrical terminals adapted to be connected to an opposite polarity terminal of the A.C. power source. The playing pieces have a pair of electrical contacts with a first diode connected thereacross, and a second diode and an electrically powered light source also connected across said contacts with the anode of one diode and the cathode of the other diode being commonly connected to the same contact. Each of the playing pieces has one of its contacts positioned to contact a receptacle terminal and its other contact positioned to be brought into electrical contact connection with the other contact of a playing piece positioned in a corresponding receptacle on a second playing surface whereby both light sources are energized.

19 Claims, 26 Drawing Figures

FIG. 4
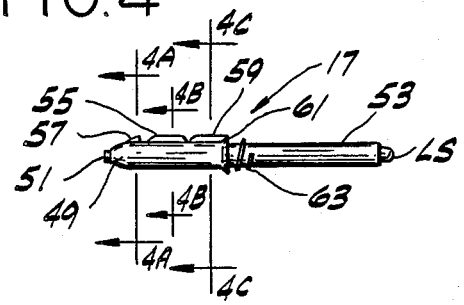
FIG. 7A
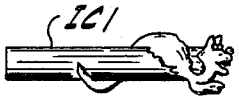
FIG. 7B
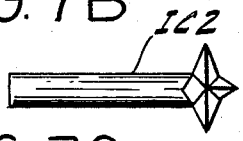
FIG. 4A
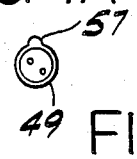
FIG. 4C
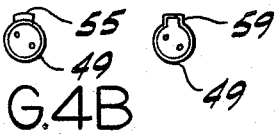
FIG. 7C
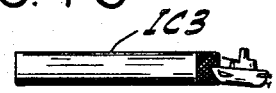
FIG. 4B
FIG. 7D
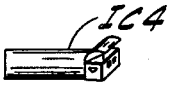
FIG. 5
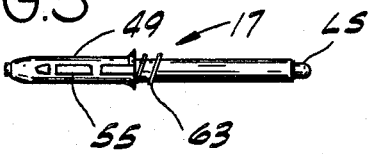
FIG. 6
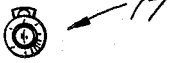
FIG. 8
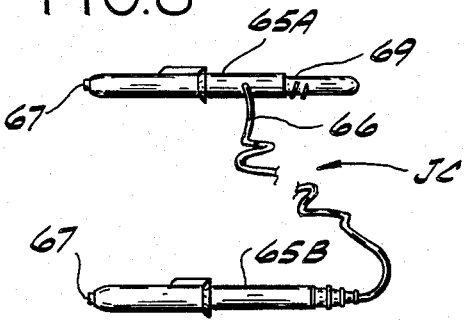
FIG. 9A
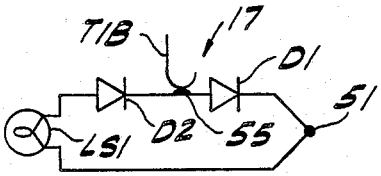
FIG. 10
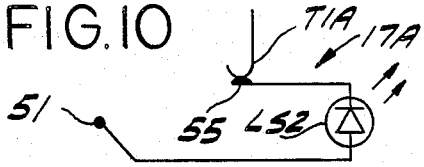
FIG. 9B
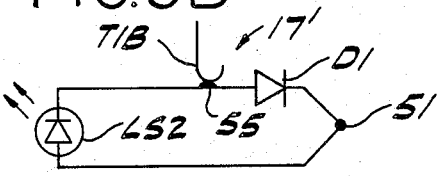
FIG. 11
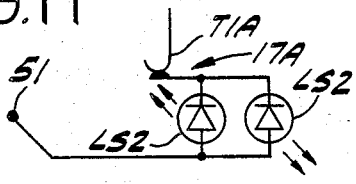

ELECTRICAL HIDDEN MOVEMENT GAME

BACKGROUND OF THE INVENTION

This invention relates to games and more particularly to games with playing pieces that may be moved in secrecy and have a light source which becomes energized or illuminated to signal or reveal the location of other movable but hidden playing pieces.

Games of stealth and deception have been played for some time. The games "Stratego" and "Battleship" have recently been commercially successful, both having elements designed to make play more exciting through hidden playing pieces or by concealing the identity of the playing pieces. The history of games with hidden movement extends back at least to the 19th century when war games played at military institutions would involve two teams of players out of sight of one another. A third group would serve as umpires, noting where each side moved their playing pieces and informing both sides when one or more of their playing pieces would be in sight of their opponents. This type of play has been used by civilian wargamers, and it currently has been adapted for use with a computer as the umpire. This type of play entails either a third party as umpire for a game in which he or she cannot participate, or the employment of expensive computing equipment.

A second method of playing games of hidden movement involves the use of opaque containers, often matchboxes, that represent spaces on a map. Chits representing playing pieces are moved by players from box to box, simulating movement from space to space. When a player finds an opponent's chit in a box he intended to move a chit into, he can then tell his opponent he has found one of his units (or playing pieces). This form of play allows only one player to move at a time, and it is inconvenient since a player cannot see where his chits are and must therefore keep a separate record.

Also, there have been wargames designed with special rules to allow hidden movement and enable simultaneous movement of playing pieces. These make board wargames more realistic, but result in complex rules and record keeping, and correspondingly decrease the "playability" of the game.

There have been several electrically operated game boards designed that permit some form of hidden movement game to be played, though most were not originally designed for that purpose. These earlier designs have been primarily meant to play "Battleship", a popular children's game normally played with paper and pencil.

Game boards designed to play "Battleship" remove the need to draw ships on paper and for players to call their "shots" and respond as to whether their "ships" have been "hit" or "missed". These "Battleship" game boards and other similar position matching games are designed for the placement of target pieces at the start of a game that are then "fired" upon one at a time. If a hit is scored, an electrical circuit is completed through the target and the device used to indicate shots. Though there may be multiple targets, there is only one signaling device that lights or buzzes when a hit is scored on an opponent's ship. This central signal still requires players to record where they have "hit" or "missed", and which of their own ships have been hit. Games of this type are shown in U.S. Pat. Nos. 4,365,811, 3,640,536 and 3,194,560.

A variant of this design is a game in which there are no fixed targets such as ships, but in which an electrical circuit is completed when pieces from both sides occupy the same space on their respective game boards, therefore energizing a central signaling device. Such a game is shown in U.S. Pat. Nos. 3,473,808, 4,231,577 and 3,537,708. In these games, the playing pieces must still be moved one at a time due to the central signaling device. If more than one "hit" were to be scored in one turn, it would be impossible to know which move resulted in the "hit". A similar game design is described in U.S. Pat. Nos. 2,799,505, 2,442,014, 2,197,306, 1,232,133 and 2,139,860.

A third form of position matching game has a signaling device, normally a light, for each playing piece that represents a target, or a light for each space on the two game boards. One game board apparatus, designed for a hidden word game, uses small light bulbs that are screwed into sockets representing letters. These sockets are linked to sockets on the opponent's game board on a letter for letter basis. The players try to duplicate their opponent's placement of bulbs, thus finding the letters in the opponent's hidden word and enabling them to guess the word before their hidden word is similarly puzzled out. Games of this type are described in U.S. Pat. Nos. 2,905,473, 3,887,189 and 3,376,041.

While all these designs allow the playing of pattern matching games and "Battleship", they have limitations in being adaptable to other types of games. The games that rely on a central signal allow only one playing piece to be moved per turn per side. The group of games with multiple light positions or pieces would allow multiple pieces to be moved per turn, though they are not designed for this type of play. However, changing the position of the playing pieces in these games is not a direct or easy process, nor are there special types of playing pieces to add interest to game play. In this game design, the movement of playing pieces is kept simple and straight forward so game play can proceed quickly. The main limitation of other game boards that is overcome by this design is that when contact occurs between playing pieces of opposing players in these games, both players immediately become aware of it. Thus, players know which of their playing pieces have been discovered and which remain hidden. This limits the uncertainty that is possible in a game of hidden movement. Since uncertainty of an opponent's intentions and his knowledge about the situation is one of the main elements of a hidden movement game, it would make for a better game if more uncertainty is introduced. If both sides cannot be sure of what is known about the position of their playing pieces, and also are able to secretly discover some of their opponent's playing pieces, much more uncertainty can be generated in a game. Besides adding uncertainty this allows better simulations of historic situations where complete knowledge of an opponent was not possible. Also, the ability of players to secretly locate opponent's playing pieces adds the dimension of intelligence gathering to game play.

SUMMARY OF THE INVENTION

Among the several objects of this invention may be noted games which permit two players or sides to sit apart from one another and play a game in which the movement of playing pieces is concealed up to the point that a playing piece from both sides is moved into the same space; the provision of games which obviate the need for a computer or a person functioning as a game umpire; the provision of a game in which two opposing players can move one or more of their respective playing pieces in secrecy during a turn, and still know which of their playing pieces occupy the same space as an opponent's playing piece; the provision of games having different types of playing pieces, one of which will indicate the presence of an opponent's regular playing piece when occupying a corresponding game board position but will not indicate this to the opponent; the provision of a game with playing pieces that can detect the presence of any playing piece of an opponent; the provision of games in which players may simulate a hidden goal or treasure and the opposing side can find the hidden goal during the game without the first player becoming aware of its discovery; the provision of games in which both the playing pieces and the receptacles or sockets thereof may be tested for operativeness; the provision of a game in which the game board is conveniently adaptable to have a wide variety of games to be played thereon; the provision of such games having playing pieces which are readily adaptable to simulate different characters in different games; and the provision of games which are simple in construction, reliable in operation and economical in cost.

Briefly, a game of this invention comprises a game board having at least a pair of substantially identical playing surfaces, one for each game player, with each playing surface positioned so that the playing surface for any one game player is obscured from the view of all other game players. Each playing surface has a plurality of receptacles, each representing a location for positioning a playing piece. The receptacles are arranged on the respective playing surfaces in substantially identical patterns with the receptacles on any one playing surface having respective correspondingly positioned receptacles on each other playing surface. A plurality of the playing piece receptacles on one playing surface each has an electrical terminal adapted to be commonly connected to one terminal of an A.C. power source while a plurality of the playing piece receptacles on a second playing surface each has an electrical terminal adapted to be connected to an opposite polarity terminal of the A.C. power source. The game also includes a plurality of playing pieces each having a pair of electrical contacts and each being adapted to mate with any receptacle. A first diode is connected across these contacts and a second diode and an electrically powered light source are also connected across these contacts with the anode of one diode and the cathode of the other diode being commonly connected to the same contact. Each of the playing pieces has one of its contacts positioned to contact a receptacle terminal and its other contact positioned to be brought into electrical contact connection with the other contact of a playing piece positioned in a corresponding receptacle on a second playing surface whereby both light sources are energized.

Other objects and features will be in part apparent and in part pointed out hereinafter.

BRIEF DESCRIPTION OF THE DRAWINGS

In the accompanying drawings, in which several of various possible embodiments of the invention are illustrated.

FIG. 4 is a side elevation of a playing piece;

FIGS. 4A, 4B and 4C are sections on lines 4A—4A, 4B—4B and 4C—4C, respectively of FIG. 4;

FIG. 5 is a top plan of the playing piece of FIG. 4;

FIG. 6 as an end elevation of the playing piece of FIGS. 4 and 5;

FIGS. 7A, 7B, 7C and 7D are side elevations of exemplary playing piece indicia;

FIG. 8 is a side elevation of a jumper conductor having plug ends adapted to be positioned in different receptacles on one surface of the game board;

FIG. 9A is a circuit diagram of one type of playing piece;

FIG. 9B is a circuit diagram of an alternate embodiment of the playing piece of FIG. 9A;

FIG. 10 is a circuit diagram of another type of playing piece;

FIG. 11 is a circuit diagram of still another type of playing piece;

Corresponding reference characters indicate corresponding parts throughout the several views of the drawings.

DESCRIPTION OF PREFERRED EMBODIMENTS

Figure 1:
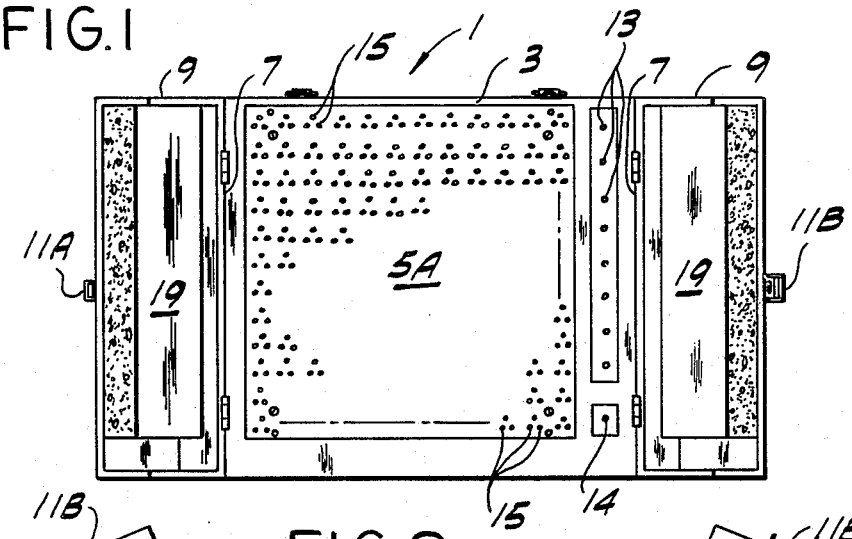
FIG. 1 is a front elevation of a game of this invention with cover doors opened to support the game board thereof in a vertical position.
Figure 2:
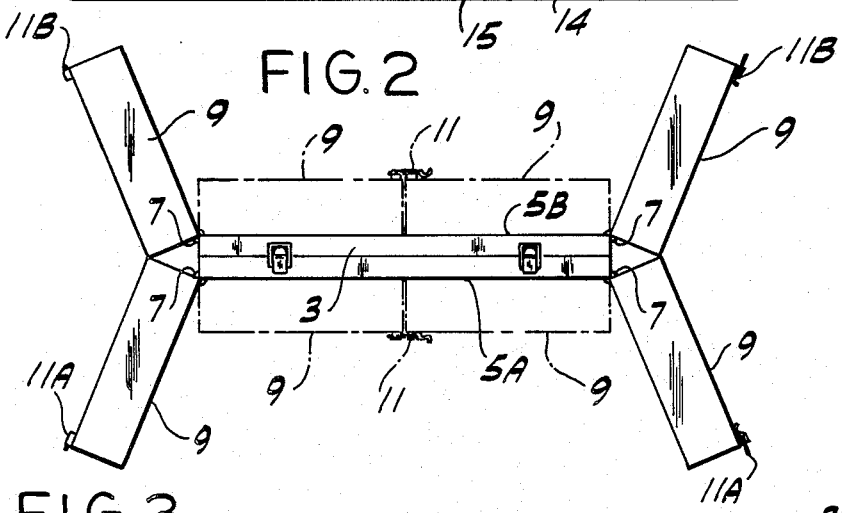
FIG. 2 is a top plan of the game of FIG. 1 with the cover doors shown in a closed position by broken lines.
Figure 3:
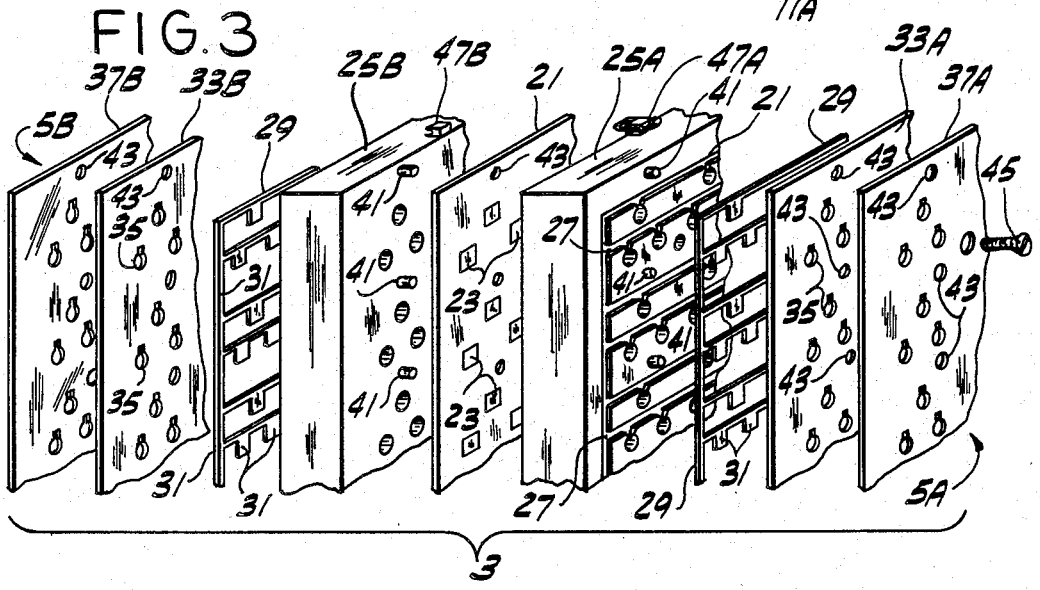
FIG. 3 is an exploded partial view of the game board.

Referring now to the drawings and more particularly to FIGS. 1–3, a game of the present invention is indicated generally at reference numeral 1 and comprises a game board 3 having a pair of substantially identical playing surfaces 5A and 5B, one side or surface for each player. As these playing surfaces are substantially parallel and face in opposite directions playing surface 5B is obscured from the view of the opposing player facing side 5A and conversely the player on side 5B cannot see playing surface 5A. Hingedly connected at one side edge 7 to opposite side edges of board 3 are pairs of identical cover-doors 9 which when closed, as shown in broken lines in FIG. 2, may be secured together by engaging latch parts 11A and 11B to completely enclose game board 3 and serve as a case for the game. When opened at an angle to plane of the game board the doors support it in an upright position on a flat surface such as a table. Thus, the two pairs of doors when so opened serve as a stand for the game board.

Game board 3 has in addition to main playing surfaces 5A and 5B, goal indicator sockets 13 and a test socket 14 on each of the opposite surfaces, and a plurality of receptacles such as sockets 15, each representing a location for positioning a playing piece 17 as illustrated in FIGS. 4–6. The receptacles are arranged on the playing surfaces 5A and 5B in substantially identical patterns with those on one surface having respective correspondingly positioned receptacles on the other surface, preferably in registry therewith. When stowed or packed for carrying the playing pieces may be left in sockets 15. These playing pieces are retained in position for transporting the game by soft resilient foamed plastic or rubber pads 19 adhered to the inner surfaces of the door.

Game board 3 is conveniently constituted by a number of layers as shown in FIG. 3. A central lamination 21 is formed of a sheet of any conventional electrically insulating or non-conductive synthetic resin material having a pattern of a plurality of spaced apart areas 23 of conductive material, such as copper or brass which are secured thereto, mechanically by punching or by adhesive bonding, or by metallizing or by using typical etching processes on a plated printed circuit board. Lamination 21 serves as a contact panel. Located on opposite sides of lamination 21 are two identical non-conductive socket panels 25A and 25B in which sockets 15 are formed by boring, punching or molding. The outer faces of panels 25A and 25B are recessed to form channels 27 adapted to receive a power supply harness 29 of conductive metal having a series of integral spaced extending conductive tabs 31 formed in a pattern to match with the recessed channels 27 and sockets 15. Tabs 31 are so arranged and positioned that they will be aligned with sockets 15 and can be directly pressed into their respective sockets and form internal conductive power supply terminals for the playing pieces. Sockets 15 are preferably not circular in cross section but unsymmetrical, such as keyhole shaped, so that a playing piece 17 of complementary cross section can be inserted in only one rotated position.

Two game indicia panels 33A and 33B, which are mirror images of each other, are positioned in alignment with socket panels 25A and 25B and have openings 35 of the same size and general shape as receptacles or sockets 15 and are in registry therewith when assembled. Lastly, clear plastic playing surface panels 37A and 37B are provided and have openings 39 of the same general shape and size as receptacles 15 and will, when assembled, align with openings 35 and receptacles 15. Socket panels 25A and 25B have a plurality of studs 41 projecting perpendicularly from opposite faces thereof and serve with openings 43 in the central lamination 21, game indicia panels 33A and 33B and playing surface panels 37A and 37B to maintain the game board assembly in precise alignment. In this embodiment screws 45 serve as the means to secure panels 37A and 37B, 33A and 33B and power supply harnesses 29 to the respective socket panels 25A and 25B which in turn are secured together by latch parts 47A and 47B at their top edges and are preferably hinged together at their bottom edges.

Playing pieces 17 (FIGS. 4–6) are of generally tubular shape and have a front or leading portion 49, which tapers to a blunt rounded nose carrying an electrical contact 51, and a reduced diameter shank portion 53. A second and preferably resilient electrical contact 55 projects from portion 49 radially in the form of a longitudinal rib portion aligned with a lead boss 57 and follower boss 59. Front portion 49 terminates at its distal end in a skirt 61 with a slight outward flare from which the shank portion 53 projects rearwardly. Shank portion 53 has a threaded circumference 63 adjacent the skirt 61 and a light source LS extending from the outer or rearward end thereof. Playing piece indicia cover IC1, depicting, for example, a dragon (FIG. 7A) with translucent eyes and mouth for transmitting light from LS, is of tubular shape and slides over the shank portion 53 of the playing piece. IC1 has an internal thread adjacent the forward end for twisting engagement with threaded circumference 63 so that it may be removably secured to playing piece 17. These additional playing piece indicia covers IC2, IC3 and IC4 are shown in FIGS. 7B–7D, respectively depicting a knight's insignia, a submarine, and a treasure chest, the former two of which permit the selective passage of light from LS.

A jumper conductor JC (FIG. 8), which serves as a hidden goal device, has two end plugs 65A and 65B with an insulated flexible conductor 66 commonly connecting electrical contacts 67 projecting centrally and longitudinally therefrom. Plug 65A, which serves to designate a hidden goal location, has a thread 69 which may, for example, accept the treasure chest indicia cover of FIG. 7D. As will be described later, plug 65B, which serves as a goal indicator, is inserted into a goal indicator socket or receptacle 13 and hidden goal plug 65A is then positioned in a selected socket 15 on a main playing surface 5A to constitute a goal position hidden from a player playing on surface 5B.

The electrical circuitry of one type of playing piece 17 is shown in FIG. 9A to include a first diode D1 connected between electrical contacts 51 and 55 and a second diode D2 serially connected with an electrically powered light source, such as incandescent lamp LS1, are also connected across contacts 51 and 55, with the anode of D2 and the cathode of D1 both connected to electrical contact 55. This contact is adapted to engage a terminal T1B formed from one of the tabs 31. The circuit of an alternate playing piece 17' is shown in FIG. 9B to have a light source LS2 comprising a light emitting diode (LED) with its anode connected to contact 55. The LED functions as both a diode, such as D2, and a light source such as incandescent lamp LS1. The LED is a preferred light source as it not only performs the function of a diode and emits light but requires much less electrical power than an incandescent lamp for generally the same illumination level. Playing pieces 17 and 17' may be referred to as regular or standard playing pieces.

Another type of playing piece 17A is shown (FIG. 10) to comprise simply an LED LS2 connected between contacts 51 and 55. The circuit diagram of a third type playing piece 17B is illustrated in FIG. 11 to include two LEDs LS2 connected across contacts 51 and 55 with opposite polarity. A single bipolar diode having both LEDs in the same envelope may be used rather than separate LEDs.

Figure 12:
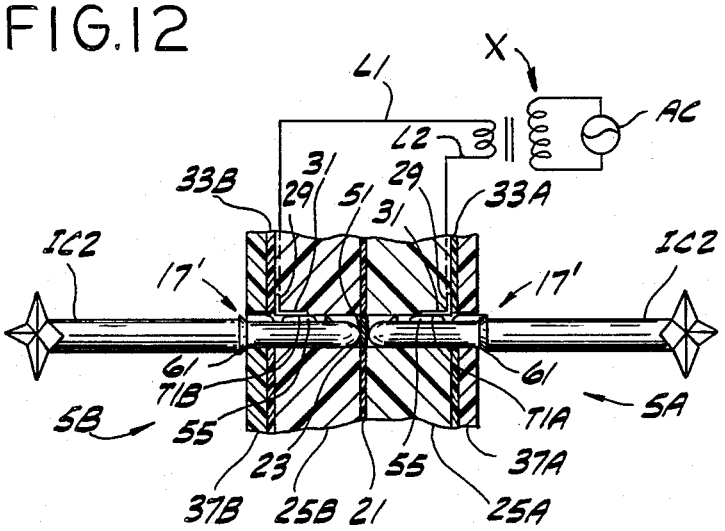
FIG. 12 is a partial section of a game board showing two correspondingly positioned receptacles with playing pieces received therein.

FIG. 12 depicts two playing pieces 17' positioned in correspondingly located receptacles on playing surfaces 5A and 5B. A source of electrical power comprising a small conventional step-down transformer X energized from any a.c. convenience outlet, for example, has its secondary winding connected by lines L1, L2 to supply low voltage a.c. power to harnesses 29, the bent-over tabs 31 thereof in respective receptacle apertures in the panels 25A and 25B comprising electrical terminals T1A and T1B. These terminals are in electrical contact with electrical contacts 55 of these playing pieces while contacts 51 are in electrical contact connection (via conductive areas 23). It is to be understood that central lamination 21 is optional, serving to block any visual communication between corresponding sockets on opposed playing surfaces. In the absence of conductive areas 23 electrical contacts 51 are brought into direct contact with each other.

Figure 13:
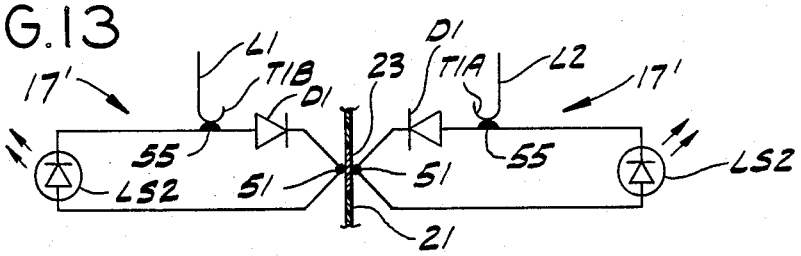
FIG. 13 is a circuit diagram of two playing pieces of the same type positioned in corresponding receptacles on opposite playing surfaces of the game board.

The schematic circuitry of two regular playing pieces such as illustrated in FIG. 12 is shown in FIG. 13. The low voltage a.c. (e.g., 3–9 volts) is applied via terminals T1A and T1B at a potential of 3–8 v.a.c. to contacts 55. During one half of each a.c. cycle current will flow from T1B through contact 55, diode D1, contacts 51 and complete a circuit through LED LS2 and contact 55 of the other playing piece to terminal T1A. On alternate half cycles current flows from L2 and terminal T1A via contact 55, through diode D1, contacts 51 and completes a circuit energizing LED LS2 of the left playing piece 17' through its contact 55 and terminal T1B. This is a basic game operation in which a playing piece 17' of the opposing player is located by trying another playing piece in different receptacles on the opposite playing surface. When the receptacle in registry with the otherwise hidden playing piece has a playing piece 17 inserted therein (as shown in FIG. 12) the LEDs in both playing pieces are energized. This signals the one player that the position of his hidden piece has been located and signals the other player that he has located a playing piece of the first player.

Figure 14:
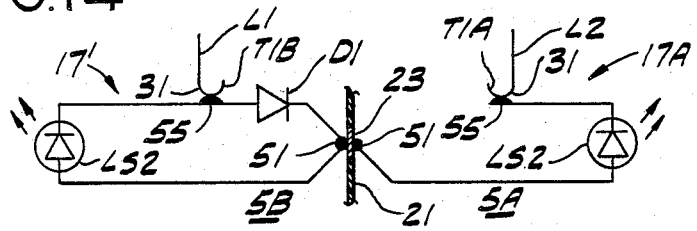
FIG. 14 is a circuit diagram of playing pieces of two different types positioned in corresponding receptacles on opposite playing surfaces of the game board.

In FIG. 14 a regular playing piece 17' is schematically shown positioned in a receptacle on playing surface 5B. With its corresponding socket on surface 5A empty no circuit is completed between L1 and L2. The player on side 5A by employing playing piece 17A may learn the location of the otherwise hidden playing piece 17' on the other side or surface 5B without signaling the opposing player on side 5B that his playing piece has been found. This is accomplished when piece 17A is inserted in a receptacle on side 5A in registry with the one into which piece 17' is plugged because a circuit is completed on alternate half cycles from L1 (via terminal T1B, contact 55, diode D1, contacts 51, LED LS2, contact 55 and terminal T1A) to L2. Thus LS2 of piece 17A lights. However, LED LS2 of piece 17' remains unenergized because current cannot flow on the alternate half cycles from L2 to L1 because of the blocking polarity of LS2 of piece 17A. Playing piece 17A may be referred to as a "spy" piece because of this function of being able to locate an opposing player's playing piece without letting him know about it.

Figure 15:
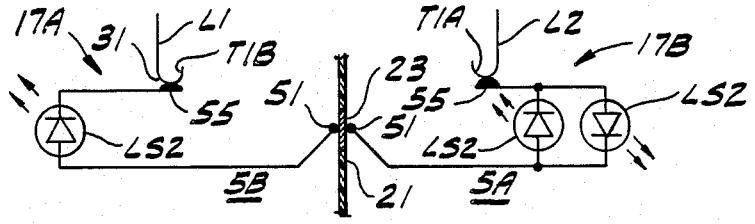
FIG. 15 is a circuit diagram of two different types of playing pieces positioned in corresponding receptacles on opposite playing surfaces of the game board.

With a playing piece having a circuit as shown in FIG. 11, however, the opponent's use of a spy piece can be detected. "Spy" piece 17A when inserted in a socket on side 5B as shown in FIG. 15 will be energized if a playing piece with either the circuit of FIG. 17' or 17B is present in the corresponding receptacle on side 5A. However, if a playing piece with the circuit of 17B is present in the receptacle on side 5A, the player will know that a playing piece has been inserted by his opponent on side 5B because one of the LEDs LS2 of his playing piece will be energized on each alternate half cycle. Thus current can flow from L2 via terminal T1A, contact 55, the outer LED LS2, contacts 51, and LS2 in the "spy" piece 17A on side 5B, its contact 55 and terminal T1B thereby completing the circuit to L1. Playing pieces with circuit 17B may be referred to as "master" playing pieces because it will have its light source energized when it is inserted in a receptacle aligned with one or the other game board surface when the latter receptacle has inserted therein a regular playing piece 17' or a spy playing piece 17A, or another master playing piece 17B.

It will be noted that the double diode circuitry of the regular playing piece 17' enables the spy playing piece 17A having only one diode to function in a unique manner as described above.

Figure 16:
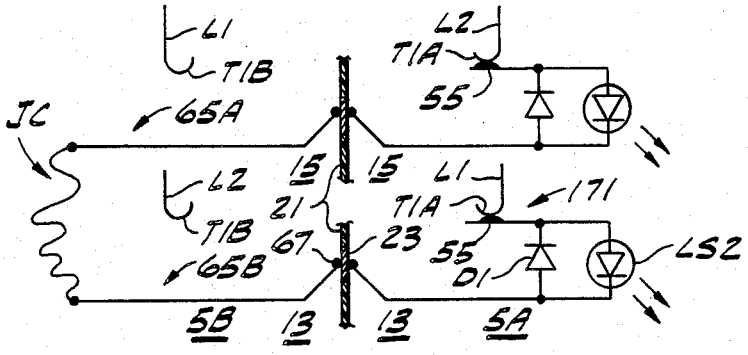
FIG. 16 is a circuit diagram of the jumper conductor of FIG. 8 when used in conjunction with two playing pieces of the same type.

FIG. 16 illustrates the circuitry when jumper conductor JC of FIG. 8 is employed by the player on side 5B to select a "goal" for his opponent to find. One goal indicator plug 65B of JC is inserted in a goal indicator socket or receptacle 13 on side 5B and the hidden goal plug end 65A is inserted in a selected receptacle 15. In order for the opposing player to locate the goal selected by the player on side 5B he must position a playing piece 17' in a goal indicator receptacle 13 on side 5A and another playing piece in a socket 15 on side 5A which corresponds to the socket, on side 5B in which the hidden goal plug 65A is positioned. Success is indicated to the player on side 5A when both LEDs LS2 in playing pieces 17' are lighted. This will occur because terminal T1A for goal socket 13 on side 5A is connected to a.c. power conductor L1 while the terminal T1A of the receptacle 15 on side 5A is connected to L2. Current can then flow from L2 through the playing piece circuitry 17' positioned in receptacle 15, the jumper conductor and the playing piece circuitry 17' positioned in goal socket 13 to L1. On one half cycle LED LS2 of one playing piece is energized while the LED LS2 of the other playing piece is energized during the other half cycle.

Figure 17:
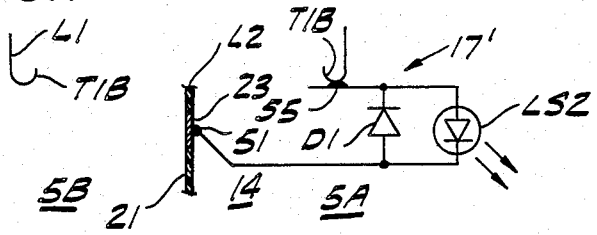
FIG. 17 is a circuit diagram of a test socket with a playing piece positioned therein for testing.

In FIG. 17 the circuitry of a test socket 14 is shown with a playing piece 17' inserted therein. The conductive area 23 in central lamination 21 is connected to conductor L2 rather than be left "floating" or unconnected as are the areas 23 at the bases of the sockets 15. Any playing piece 17', 17A, or 17B inserted in test socket 14 will be lighted during alternate half cycles if it is functioning properly. A playing piece may be tested on the other side of the game board in the same way.

It will be understood that sockets or receptacles 15 may be arranged in any pattern desired, such as in subgroups of 3 in grid array as is shown in FIG. 1, or other symmetrical or unsymmetrical patterns.

Figure 18:
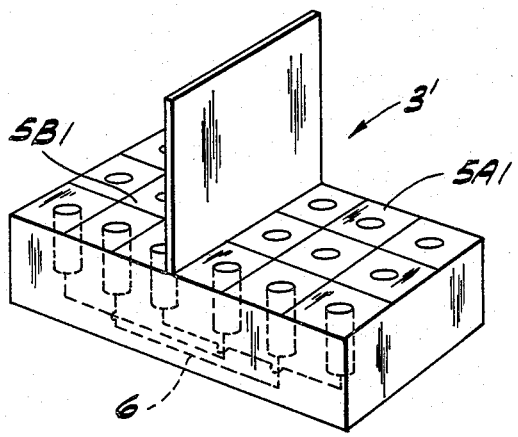
FIG. 18 is a perspective view of an alternate embodiment of a game of this invention in which the playing surfaces of the game board are horizontal.

It will also be understood that the game board may comprise two playing surfaces 5A' and 5B' which are horizontal rather than vertical as described in FIGS. 1–3. FIG. 18 illustrates such a game board 3' having an opaque divider 4 to block the view of the opponent's playing surface. In this instance the base of each socket on side 5A is connected to the base of a corresponding socket on side 5B, as indicated by conductors 6. The game is otherwise generally the same as that of FIGS. 1–3 as described above.

The following is a description of the operation of this invention as exemplified in the playing of two different games.

Hidden Treasure Game

The object of this game is for one player to capture his opponent's treasure before his own is captured. For this game, the two-sided game board 3 has opposed 8×8 space playing surfaces 5A and 5B with one socket 15 per space, plus two goal indicator sockets 13. Each side is provided with a set of 16 playing pieces—8 spy pieces 17A, 5 regular playing pieces 17', 3 master playing pieces 17B, and 1 hidden goal jumper JC. One set is blue and one is grey.

Each playing surface 5A and 5B is divided in half, the top four rows are grey and the bottom four rows are blue. The Grey player may place all but one of his playing pieces and his treasure, represented by hidden goal plug 65A of his hidden goal jumper JC, anywhere on the grey half of the playing surface; the Blue player does the same on the blue half. After both sides place all but one of their regular playing pieces on the game board, the Grey player sets up his hidden treasure signal by placing his goal indicator plug 65B in one of the goal indicator sockets 13. He then tells the Blue player into which goal indicator socket 13 he should place a regular playing piece 17' that is to serve as the hidden goal indicator for Blue during the game. The Blue player repeats the process to establish the Grey player's hidden goal indicator. The first player to capture his opponent's treasure wins, or, alternatively, a player may win by capturing all his opponent's regular 17' and master playing pieces 17B.

Movement is limited to one space in any direction, including diagonally, per turn. All of a player's spy pieces 17A and one regular 17' or master piece 17B may be moved during a turn. The treasure piece 65A is not moved normally. If a player desires, as one of his turns he may move his treasure piece 65A to a space occupied by one of his regular 17' or master playing pieces 17B. He must, however, surrender that regular or master playing piece to his opponent. The Grey player moves first, then turns alternate. A player makes a capture when he moves a playing piece into a socket 15 already occupied by an opponent's playing piece. This causes both playing pieces to light, and the player that moved into the space asks to be handed the playing piece he has just captured.

Spy pieces 17A cannot capture opponent's playing pieces, nor locate the opponent's hidden treasure piece 65A. Spies 17A can only locate an opponent's regular 17' and master 17B playing pieces. Master pieces 17B can find and capture any playing piece, including spy pieces 17A. A regular playing piece 17' cannot detect a spy piece 17A but it can be used to capture any other type of playing piece.

To capture an opponent's treasure once it is found, and therefore win the game, a player must bring two of his regular 17' or master 17B playing pieces into spaces adjacent to his opponent's hidden treasure piece 65A.

Submarine Warfare Game

Figure 19:
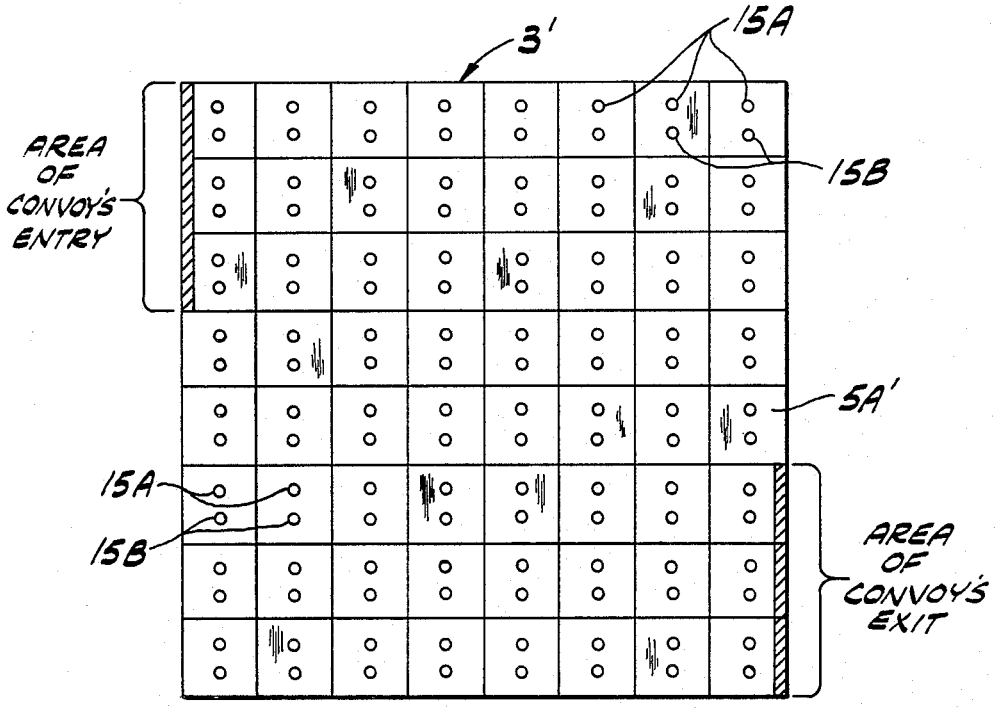
FIG. 19 is an enlarged view of one surface of a game board for playing an exemplary game.

Again, the two-sided game board has an 8×8 space playing surface. As shown in FIG. 19 game board 31 has opposing surfaces 5A' and 5B' with two independent sockets 15A and 15B per space arranged vertically. The upper socket 15A in each space is used for surface ships, and is called the surface socket. The lower socket 15B in each space is for the submarine pieces—the sub socket.

One player is the convoy commander, and gets nine regular playing pieces 17'. Three are used as destroyers, three as cargo ships and three that can be used with the destroyers as sonar (see below). The other player is the submarine commander with three regular playing pieces 17' as submarines and three spy pieces 17A that can be used with the submarines as periscopes (see below).

The convoy commander must get across the playing surface with one cargo ship to win. The submarine commander wins by sinking all the cargo ships.

All movement takes place vertically and horizontally—there are no diagonal moves. A submarine piece may move in either the surface socket 15A or sub socket 15B. In a surface socket, a submarine 17' can be moved two spaces per turn. In the sub socket, a submarine can be moved one space per turn. A submarine piece that has been moved on the surface must stay in a surface socket 15A after the end of the submarine commander's turn.

Merchant ships 17' move one space per turn in a surface socket.

Destroyers 17' are moved up to three spaces per turn in a surface socket 15A or two spaces per turn if the destroyer is using sonar (see below).

When a submarine 17' is moving in sub sockets, it may use a spy piece 17A as a periscope to check the surface sockets 15A of the spaces through which it is passing. A submarine may leave its 'periscope up' at the end of a turn, i.e., its spy piece 17A is left in the surface socket of the space it occupies.

A destroyer 17' may use a second regular playing piece 17' to check the sub sockets 15B of the spaces through which it passes, thus mimicking the use of sonar. The destroyer can only move two spaces a turn when using sonar, and at the end of a turn the playing piece 17' representing sonar can be left in the sub socket of the space the destroyer occupies.

Merchant ships 17' cannot capture submarines. Destroyers 17' capture any submarine in a surface socket 15A that they detect during a turn. When a destroyer 17' detects a submarine 17' in a sub socket 15B using a sonar piece 17' it must remain in contact with the submarine 17' through the next turn to capture it. A submarine 17' moving in surface sockets 15A can capture any merchant ship 17' it runs across. If it runs across a destroyer 17' while in a surface socket 15A it must move to a sub socket 15B in one of the four spaces adjacent to the destroyer's space to simulate escape maneuvers. An undetected submarine in a sub space 15B captures any one cargo ship or destroyer it finds during a turn, including any piece with which it may be in contact at the beginning of a turn. After a capture, the submarine 17' may move into a sub socket 15B in one of the four squares adjacent to the space in which the capture was affected.

To begin play, the submarine commander places his three submarines 17' anywhere on the playing surface 5B' in surface sockets 15A. The convoy commander then enters any or all of this playing pieces 17' from the top three spaces along the left border of his playing surface 5A'—which is the sub commander's right border on his playing surface 5B'. To win, the convoy commander must exit at least one cargo ship 17' from any one of the bottom three spaces along the right border of his playing surface 5A'. Thus, he must move his convoy from one corner to the corner diagonally opposite his starting position. After the convoy commander finishes his first turn, play then alternates between sides with each player moving any or all of his playing pieces during his turn.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A game comprising:

a game board having at least a pair of substantially identical playing surfaces, one for each game player, with each playing surface positioned so that the playing surface for any one game player is obscured from the view of all other game players;

each playing surface having a plurality of receptacles, each representing a location for positioning a playing piece, said receptacles being arranged on the respective playing surfaces in substantially identical patterns, the receptacles on any one playing surface having respective correspondingly positioned receptacles on each other playing surface, a plurality of said playing piece receptacles on one playing surface each having an electrical terminal adapted to be commonly connected to one terminal of an A.C. power source, a plurality of said playing piece receptacles on a second playing surface each having an electrical terminal adapted to be connected to an opposite polarity terminal of the A.C. power source;

a plurality of first playing pieces each adapted to mate with any receptacle and having a pair of electrical contacts, a first diode connected across said contacts, and a second diode and an electrically powered light source also connected across said contacts with the anode of one diode and the cathode of the other diode being commonly connected to the same contact; each of said playing pieces having one of its contacts positioned to contact a receptacle terminal and its other contact positioned to be brought into electrical contact connection with the other contact of a playing piece positioned in a corresponding receptacle on a second playing surface whereby both light sources are energized.

2. A game as set forth in claim 1 wherein a light-emitting diode comprises the second diode and the light source.

3. A game as set forth in claim 1 which further includes a second type of playing piece which has a pair of electrical contacts and a diode and an electrically powered light source connected across said contacts, the diode in the second type of playing piece being connected between the contacts thereof with its polarity opposite to that of the second diode of the first said playing piece whereby when two different types of playing pieces are positioned in corresponding receptacles on two playing surfaces one contact of each piece contacts the electrical terminal of its respective receptacle and the other contact of the first type playing piece is brought into electrical contact connection with the corresponding other contact on said second type playing piece and only the light source of the latter piece is energized.

4. A game as set forth in claim 3 wherein a light emitting diode comprises the diode and the light source of the second type of playing piece.

5. A game as set forth in claim 3 which further includes a third type playing piece which has a pair of electrical contacts and a pair of light-emitting diodes connected thereacross with opposite polarity whereby when either the first or second type playing piece is positioned in a receptacle on one playing surface and a third type playing piece is positioned in a corresponding receptacle in a second playing surface at least one of the light-emitting diodes of the third type playing piece and the electrically powered light source of the first type or the second type playing piece are energized and emit light.

6. A game as set forth in claim 5 wherein the pair of light-emitting diodes in said third type of playing piece comprises a bipolar light-emitting diode.

7. A game as set forth in claim 1 wherein two playing surfaces comprise opposite sides of a vertical game board and the pattern of receptacles on one surface is a mirror image of the pattern of receptacles on the other playing surface.

8. A game as set forth in claim 7 wherein the receptacles are sockets into which the playing pieces are inserted, each socket on one playing surface being aligned with the socket of its respective corresponding receptacle on the other playing surface.

9. A game as set forth in claim 8 wherein pieces of conductive material are sandwiched between the opposed playing surfaces to block visual communication between corresponding sockets on opposed playing surfaces while providing electrical continuity therebetween.

10. A game as set forth in claim 9 wherein certain of the pieces of conductive material are large enough to span the distance between a plurality of receptacles whereby a playing piece positioned in any one of said receptacles on one playing surface will have its light source energized if there is a playing piece positioned in any one of a corresponding plurality of receptacles on the other playing surface.

11. A game as set forth in claim 1 wherein the receptacles are sockets and the playing pieces are generally tubular in shape having one end adapted to be inserted in any receptacle socket and with the light source positioned adjacent the other end thereof, said one end carrying one of said contacts spaced from the socket's surfaces and the other playing piece contact positioned on a surface adjacent said one end of the playing piece and adapted to contact the surface of the socket, said electrical terminal of each receptacle comprising electrically conductive material positioned on the inside surface of each playing piece receptacle.

12. A game as set forth in claim 11 wherein the receptacles are unsymmetrical in cross section and the generally tubular shaped playing pieces have a complementary shaped cross section in the portion adjacent said one end thereof.

13. A game as set forth in claim 11 wherein the portion of the tubular shaped playing pieces adjacent said other end thereof have a shape adapted to have removably secured thereto different indicia representing different symbols used in playing different games.

14. A game as set forth in claim 1 which further includes a first pair of corresponding receptacles on the two playing surfaces which have their respective electrical terminals connected in reversed polarity relative to the plurality of receptacles on said respective playing surfaces, a piece of conductive material interposed between said first pair of receptacles and insulated therefrom, and a removable jumper conductor adapted to connect said electrically conductive piece of material to a piece of electrically conductive material interposed between two other corresponding receptacles on the two playing surfaces whereby when one end of said jumper conductor is positioned in one of said first pair of receptacles on one playing surface and the other jumper end is positioned in another receptacle on the same playing surface, a playing piece positioned in the other of the corresponding receptacles on the other playing surface will have its light source energized upon positioning another playing piece in the other of the first pair of receptacles on the other playing surface.

15. A game as set forth in claim 1 which further includes corresponding receptacles on the two playing surfaces having their respective electrical terminals adapted to be commonly connected to one terminal of said A.C. power source and each adapted to be contacted by one of the contacts of a playing piece and a piece of electrically conductive material positioned to be contacted by the other contact of a playing piece positioned in either one of the last said receptacles, said electrically conductive piece of material being connected to the opposite polarity terminal of said power source, whereby a playing piece may be tested for operativeness by insertion into either of the last said corresponding receptacles.

16. A game as set forth in claim 1 wherein the game board comprises a pair of first panels of electrically nonconductive material each having a plurality of holes therethrough arranged in the same pattern, each panel having a plurality of commonly connected electrically conductive contact portions each of which is secured to an interior surface of a receptacle to form an electric terminal therefor, a pair of overlay panels one for positioning on the surface of each said first panels and carrying game indicia removably facially secured thereto, said overlay panels each having a plurality of holes arranged in the same pattern as those in the aforesaid pair of panels and for alignment therewith thereby to form a plurality of receptacles for playing pieces.

17. A game as set forth in claim 16 which further includes an electrically nonconductive sheet with a plurality of areas of conductive material arranged in a pattern to correspond generally to the pattern of receptacles to block visual communication betwen the first panels while providing electrical continuity therebetween.

18. A game as set forth in claim 16 wherein said first panels are hinged along one edge thereof and which further includes latch means on an opposite edge thereof to hold said first panels together in assembled aligned relationship.

19. A game as set forth in claim 18 further comprising pairs of doors respectively hingeably connected to opposite side edges of the game board and which when closed enclose and cover both playing surfaces of the game board and when opened at an angle to the plane of the game board support it in an upright position.

* * * * *